US010028340B2

(12) United States Patent
Archer

(10) Patent No.: US 10,028,340 B2
(45) Date of Patent: Jul. 17, 2018

(54) WALL MOUNTED AC TO DC CONVERTER GANG BOX

(71) Applicant: ERP POWER, LLC, Moorpark, CA (US)

(72) Inventor: Michael Archer, Moorpark, CA (US)

(73) Assignee: ERP POWER, LLC, Moorpark, CA (US)

( * ) Notice: Subject to any disclaimer, the term of this patent is extended or adjusted under 35 U.S.C. 154(b) by 0 days.

(21) Appl. No.: 15/336,767

(22) Filed: Oct. 27, 2016

(65) Prior Publication Data

US 2017/0118809 A1 Apr. 27, 2017

Related U.S. Application Data

(63) Continuation-in-part of application No. 15/336,751, filed on Oct. 27, 2016.

(60) Provisional application No. 62/247,032, filed on Oct. 27, 2015.

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/0812; H05B 33/0815; H05B 33/0836; H05B 33/0839
USPC ..... 315/224, 225, 226, 276, 291, 308
See application file for complete search history.

(56) References Cited

U.S. PATENT DOCUMENTS

| | | | | |
|---|---|---|---|---|
| 5,175,477 | A | 12/1992 | Grissom | |
| 6,061,261 | A | 5/2000 | Chen et al. | |
| 6,933,686 | B1 | 8/2005 | Bishel | |
| D616,838 | S | 6/2010 | Samuels et al. | |
| 8,294,379 | B2 | 10/2012 | Liu et al. | |
| 8,752,972 | B2 * | 6/2014 | Bonarirgo | H02J 9/02 362/95 |
| 8,901,841 | B2 | 12/2014 | Choi et al. | |
| 2004/0041620 | A1 | 3/2004 | D'Angelo et al. | |
| 2009/0079367 | A1 | 3/2009 | Crouse et al. | |
| 2012/0043899 | A1 * | 2/2012 | Veskovic | H05B 41/295 315/200 R |

(Continued)

FOREIGN PATENT DOCUMENTS

| | | | |
|---|---|---|---|
| JP | 2005-235691 | A | 9/2005 |
| JP | 2013-165048 | A | 8/2013 |
| JP | 3187941 | U | 12/2013 |

OTHER PUBLICATIONS

International Search Report and Written Opinion for corresponding PCT Application No. PCT/US2016/059235, dated Jan. 3, 2017 (7 sheets).

*Primary Examiner* — Thuy Vinh Tran
(74) *Attorney, Agent, or Firm* — Lewis Roca Rothgerber Christie LLP

(57) ABSTRACT

A dual stage power converter capable of being installing in a one-gang box and powering an LED load is presented. The dual stage converter includes a power factor correction (PFC) stage operating in transition mode and a resonant converter stage operating at a fixed frequency with a fixed duty cycle and dead time. A dimmer input is included to select a desired luminosity of the LED load. A main controller adjusts the value of the voltage output from the PFC stage in order to maintain the voltage output from the resonant stage at the desired level.

22 Claims, 6 Drawing Sheets

(56) References Cited

U.S. PATENT DOCUMENTS

| | | | | |
|---|---|---|---|---|
| 2012/0062133 | A1 | 3/2012 | Cubias | |
| 2013/0038227 | A1 | 2/2013 | Yan et al. | |
| 2013/0093332 | A1 | 4/2013 | Lee et al. | |
| 2013/0093357 | A1 | 4/2013 | Lee et al. | |
| 2013/0229126 | A1 | 9/2013 | Ribarich et al. | |
| 2013/0300310 | A1 | 11/2013 | Hu | |
| 2014/0091720 | A1* | 4/2014 | Brinlee ..... | H05B 33/0815 315/186 |
| 2014/0239833 | A1 | 8/2014 | McCune, Jr. | |
| 2014/0239844 | A1 | 8/2014 | Bruwer | |
| 2014/0300289 | A1 | 10/2014 | Zhu | |
| 2015/0108912 | A1 | 4/2015 | Tikkanen et al. | |

* cited by examiner

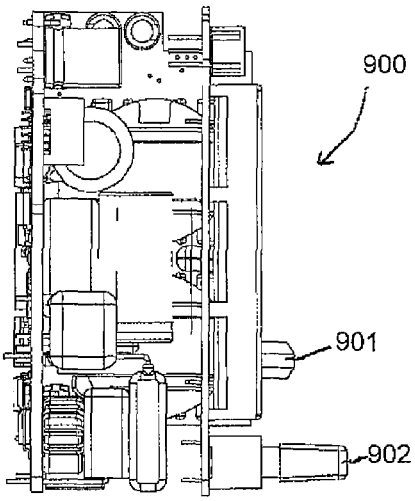
*FIG.* 9B
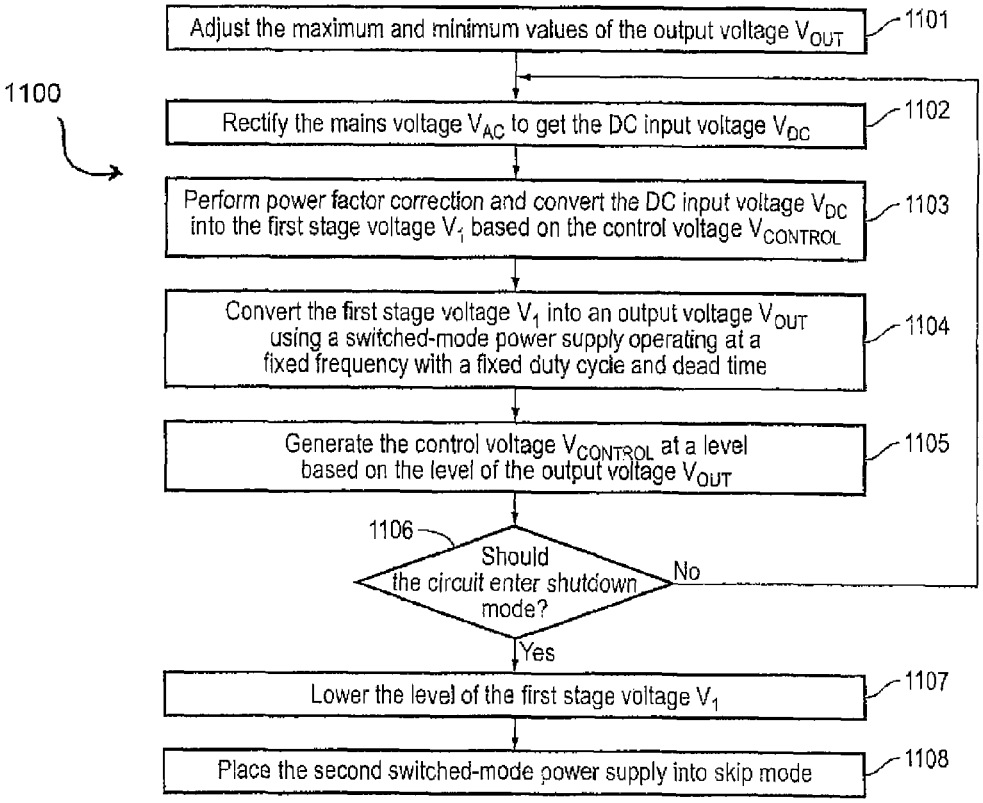
*FIG.* 10

WALL MOUNTED AC TO DC CONVERTER GANG BOX

CROSS-REFERENCE TO RELATED APPLICATION

The present application claims priority to and the benefit of U.S. Provisional Application Ser. No. 62/247,032, filed Oct. 27, 2015, entitled "WALL MOUNTED AC TO DC CONVERTER GANG BOX", and the present application is a continuation-in-part of U.S. application Ser. No. 15/336,751, filed Oct. 27, 2016, entitled "WALL MOUNTED AC TO DC CONVERTER GANG BOX", the entire contents of which are both incorporated herein by reference in their entirety.

TECHNICAL FIELD

The present invention relates generally to the field of commercial and household lighting, and more particularly to the field of improved engineering and performance in LED lighting systems.

BACKGROUND

Light emitting diodes (LEDs) are increasing in popularity as light sources, replacing traditional light sources such as incandescent and fluorescent lamps. LEDs are increasingly being used as built-in lighting in structures, and structures are being retrofitted to replace conventional lighting with LED lighting. LEDs are driven using direct current (DC) sources. Some conventional light sources such as incandescent lamps are driven using alternating current (AC) sources. Additional circuitry beyond that used by conventional AC driven light sources may be needed to allow the DC LEDs to be driven using the AC mains voltage.

In some conventional solutions, the additional circuitry may be hard-wired into the structure. The hard-wiring increases cost and space requirements, and results in the wiring being completely incompatible with AC driven light sources. When retrofitting a structure with LED lighting, the hard-wiring may require tearing walls open and fitting additional circuitry in tight spaces, if sufficient space even exists. Other times, the additional circuitry is incorporated into the light source. This increases the size and cost of the light source, and often requires the additional circuitry to be replaced when the light source needs to be replaced. Further, light sources may be used with dimmer switches. Conventional dimmer switches may receive the AC mains voltage and reduce the amplitude of the AC signal delivered to the light source. This may not be compatible with the AC-to-DC circuitry driving an LED light source.

FIG. 1 is a block diagram of a related art LED lighting installation. The dimmer switch module 104, such as a TRIAC module, is installed in a one-gang box 110, receives an AC line voltage input 102 and outputs a modified AC voltage signal to provide a varying RMS voltage through in-wall wiring 112 to the power supply module 106, such as an external power supply for an LED lamp. The power supply module 106 converts this modified AC voltage signal to drive the LED illumination device 108. As traditional lighting installations do not account for the external power supply module 106 included in this installation, new in-wall wiring 112 and additional wiring 114 between the power supply module 106 and LED illumination device 108 may be required.

This Background section and the appended FIGURE are only for enhancement of understanding of the background of the invention, and therefore it may contain information that does not form the prior art that is already known to a person of ordinary skill in the art.

SUMMARY

In one embodiment of the present disclosure, an LED driver can include a power converter and a dimmer input. The power converter is configured to receive the AC mains voltage and to output a DC output voltage for driving an LED device. The dimmer input is configured to vary a level of the DC output voltage. The LED driver is configured to be installed within a one-gang box. In another embodiment, the power converter is configured to generate up to a 100 watt output. In another embodiment, the power converter is configured to have an efficiency of at least 92%. In another embodiment, the power converter is a dual stage power converter that can include a power factor correction stage and a resonant converter stage.

In an alternative embodiment, the power converter can include a rectifier, a power factor correction (PFC) converter stage, a resonant converter stage, and a main controller. The rectifier is configured to receive the AC mains voltage and convert the AC mains voltage into a DC input voltage. The PFC converter stage is configured to receive the DC input voltage, perform power factor correction, and generate a first stage voltage at a level, the level of the first stage voltage based on a control voltage. The resonant converter stage is configured to operate at a fixed frequency with a fixed duty cycle and dead time, receive the first stage voltage, and generate the output voltage at a level based on the level of the first stage voltage. The main controller is configured to receive the output voltage and to generate the control voltage based on the output voltage. In another alternative embodiment, the PFC converter stage is configured to operate in transition mode. In another alternative embodiment, the PFC converter stage comprises a boost converter. In another alternative embodiment, the resonant converter stage comprises a series resonant converter. In another alternative embodiment, the resonant converter stage comprises an LLC resonant converter. In another alternative embodiment, the output voltage is the voltage delivered to the LED device, and the main controller controls the control voltage such that the output voltage has a constant value.

In another alternative embodiment, the output voltage is a current sense voltage corresponding to an output current in the LED device, and wherein the main controller uses the current sense voltage as a feedback to control the control voltage such that the output current has a constant value. In another alternative embodiment, the dimmer input is configured to generate a dimmer voltage at a level, and wherein the main controller is configured to control the control voltage to maintain the output voltage at a level based on the dimmer voltage level. In another alternative embodiment, the main controller is configured to be programmed with a maximum value of the output voltage and a minimum value of the output voltage. In another alternative embodiment, the LED driver can include a first trim potentiometer coupled to the main controller, wherein the main controller can control the output voltage to a maximum value, and wherein the first trim potentiometer is configured to determine the maximum value of the output voltage.

In another alternative embodiment, the LED driver can include a second trim potentiometer coupled to the main controller, wherein the main controller can control the output voltage to a minimum value, and wherein the first trim potentiometer is configured to determine the minimum value of the output voltage. In another alternative embodiment, the LED driver can include a skip circuit, the skip circuit configured to cause the resonant converter stage to enter a skip mode when the control voltage is below a reference level. In another alternative embodiment, when the resonant converter stage is in skip mode, the output voltage is below a threshold required to bias the LED device. In another alternative embodiment, the skip circuit causes the resonant converter stage to enter the skip mode by periodically enabling and disabling the resonant converter stage.

In another alternative embodiment, the LED driver can include an electromagnetic interference circuit. In one embodiment, the LED driver can include a housing, the housing configured to contain the rectifier, the PFC converter stage, the resonant converter stage, and the main controller, the housing further configured to be installable in the one-gang box.

In another embodiment of the present disclosure, a power converter can include a rectifier, a power factor correction (PFC) converter stage, a resonant converter stage, and a main controller. The rectifier is configured to receive an AC input voltage and convert the AC input voltage into a DC input voltage. The PFC converter stage is configured to receive the DC input voltage, perform power factor correction, and generate a first stage voltage at a level, the level of the first stage voltage based on a control voltage. The resonant converter stage is configured to operate at a fixed frequency with a fixed duty cycle and dead time, receive the first stage voltage, and generate the output voltage at a level based on the level of the first stage voltage. The main controller is configured to receive the output voltage and to generate the control voltage based on the output voltage.

In another embodiment of the present disclosure, a method of converting power with reduced conducted emissions and radiated emissions can include receiving an AC input voltage; generating a DC input voltage by rectifying the AC input voltage; converting the DC input voltage to a first stage voltage, comprising performing power factor correction and converting the DC input voltage to a level based on a level of a control voltage; converting the first stage voltage into an output voltage using a switched-mode power supply operating at a fixed frequency with a fixed duty cycle and dead time; and generating the control voltage based on the output voltage. In another alternative embodiment, generating the control voltage based on the output voltage is controlling the level of the first stage voltage to maintain the output voltage at a constant level. In another alternative embodiment, generating the control voltage based on the output voltage is controlling the level of the first stage voltage to maintain an output current at a constant level.

In another alternative embodiment, generating the control voltage based on the output voltage can include receiving a dimmer voltage, comparing the dimmer voltage to the output voltage, and controlling the level of the first stage voltage to maintain the output voltage at a level based on the level of the dimmer voltage. In another alternative embodiment, the method can include setting a maximum value for the dimmer voltage, and setting a minimum value for the dimmer voltage. In another alternative embodiment, the method can include entering a shutdown mode, which can include lowering the level of the first stage voltage, and placing the switched-mode power supply in a skip mode. In another alternative embodiment, placing the switched-mode power supply into skip mode is periodically enabling and disabling the switched-mode power supply. In another alternative embodiment, the switched-mode power supply is a resonant converter. In another alternative embodiment, performing power factor correction is using a second switched-mode power supply operating in transition mode.

These and other features, aspects and advantages of the present invention will be more fully understood when considered with respect to the following detailed description, appended claims, and accompanying drawings. Those of skill in the art will appreciate that the following detailed description is to enable one of ordinary skill in the art to make and use the claimed invention, and that the description and drawings should not be construed as limiting in any manner.

BRIEF DESCRIPTION OF THE DRAWINGS

The accompanying drawings, together with the specification, illustrate example embodiments of the present invention, and, together with the description, serve to explain the principles of the present invention.

FIG. 9B is side cross sectional view of the LED driver of FIG. 9A.

FIG. 10 is a flow chart depicting a method of converting power according to embodiments of the present disclosure.

DETAILED DESCRIPTION OF THE PREFERRED EMBODIMENTS AND VARIATIONS THEREOF

Figure 1:
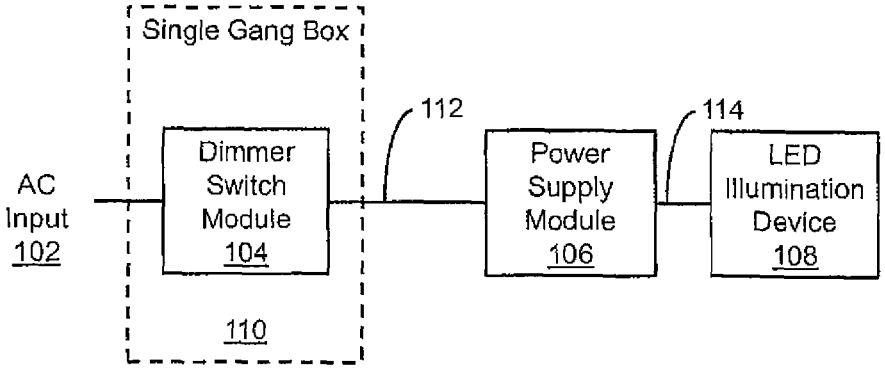
RELATED ART FIG. 1
FIG. 1 is a block diagram of a related art LED lighting installation.

In the following detailed description, preferred and example embodiments of the present invention are shown and described for the purpose of enabling one of skill in the art to make and use the claimed invention. As those skilled in the art would recognize, the invention may be embodied in many different forms and should not be construed as being limited to the embodiments set forth herein. Descriptions of features or aspects within each example embodiment should typically be considered as available for other similar features or aspects in other example embodiments. Like reference numerals designate like elements throughout the specification.

In general terms, embodiments of the present disclosure are directed to a high-efficiency power converter for powering an LED or a string of LEDs that is capable of being contained within a one-gang box. Within this compact footprint, the power converter receives the AC mains voltage from the wall and generates sufficient power for an external LED load without generating unacceptable conducted emissions and radiated emissions that may impact the electromagnetic compatibility of the power converter. Some preferred embodiments may generate up to 100 W of power. Further, in some alternative embodiments, the power converter may generate the output power with at least 92% efficiency with respect to the input power. Some other alternative embodiments include a dimmer input capable of varying the output of the power converter, and therefore the luminosity of any external LED load.

Because of its compact footprint, the power converter may be installed in a one-gang box, such as a wall mounted switch box, and wired directly to an external LED load. When retrofitting a structure to replace AC powered lighting fixtures with LEDs, the power converter may be installed in an existing one-gang box and the external LED load may be plugged into the existing light socket, thereby retrofitting the structure without altering the original wiring.

I. System

Figure 2:
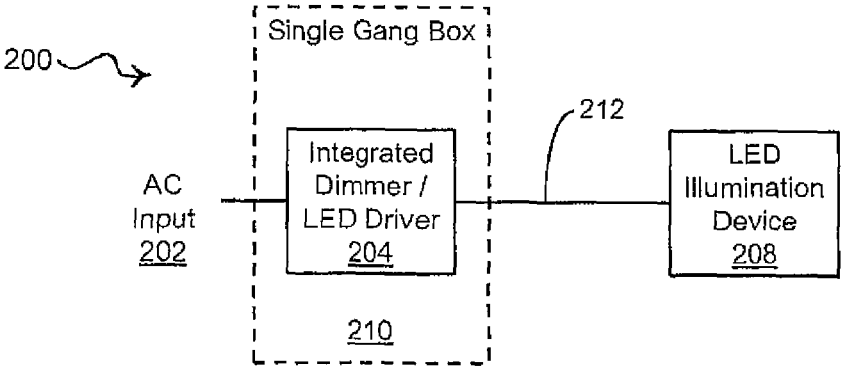
FIG. 2 is a block diagram of an LED lighting installation according to embodiments of the present disclosure.

FIG. 2 is a schematic block diagram of an LED lighting installation 200 according to one or more preferred embodiments of the present disclosure. The integrated dimmer/LED driver 204 can be installed within the single gang box 210. The integrated dimmer/LED driver 204 functions to receive an AC line voltage input 202 and convert it to a variable DC voltage, wherein the DC voltage is dependent on the dimmer interface settings. The DC output can be transferred via the existing building wiring 212 in order to power the LED illumination device 208.

Figure 3:
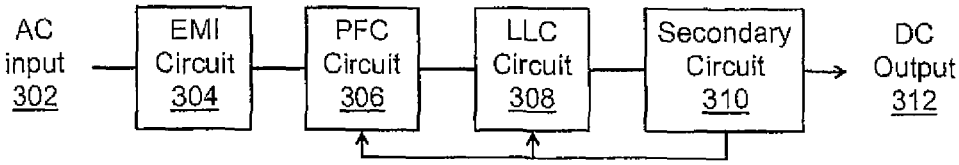
FIG. 3 is a block diagram of an LED driver according to embodiments of the present disclosure.

FIG. 3 is a schematic block diagram of an LED driver 204 according to one or more preferred embodiments of the present disclosure. As shown in FIG. 3, the AC input voltage 302 can preferably be filtered through an EMI filter circuit 304 in order to reduce electromagnetic interference before being transferred to the other components of the circuit. A power factor correction circuit 306 can function to reduce the amount of reactive power generated in order to maintain high efficiency, operating based on input from the EMI filter circuit 304 and the secondary circuit 310. The LLC resonant converter circuit 308 preferably functions to convert the filtered AC line voltage to DC voltage. The secondary circuit 310 preferably functions to monitor the DC voltage output 312 and provide signals to the power factor correction circuit 306 and the LLC resonant converter circuit 308 in order to maintain efficient output and correct for voltage and current conditions. The DC output 312 can be modified by the dimming interface before being transferred through existing building wiring to an LED illumination device. This configuration is highly efficient and packed in a single gang box.

Figure 4:
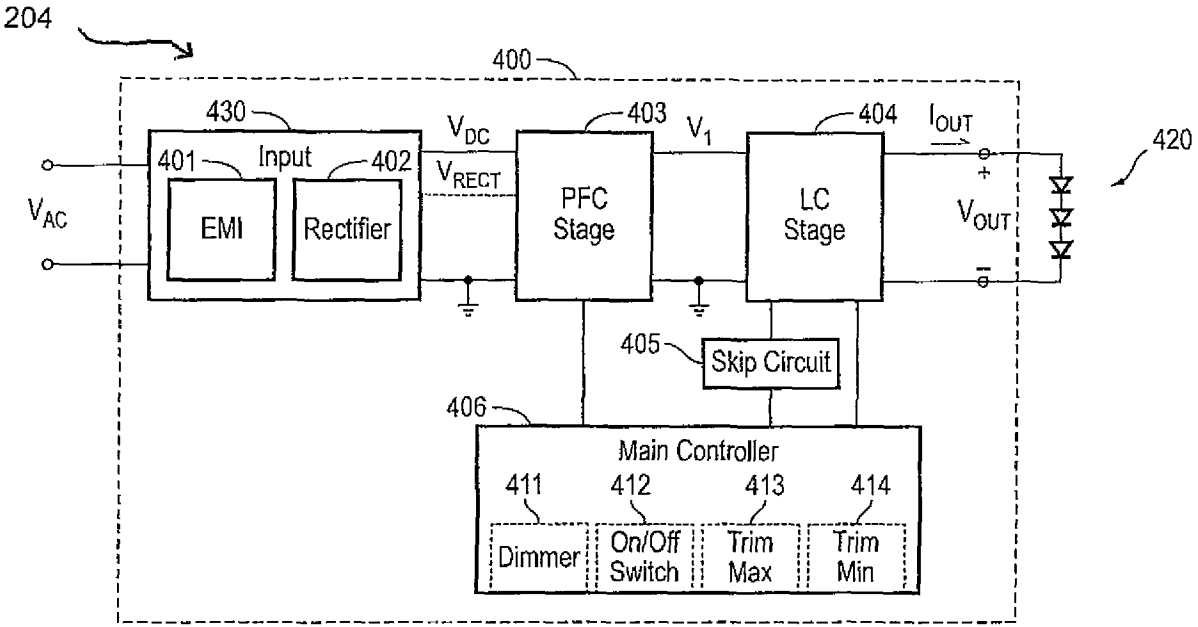
FIG. 4 is a block diagram of an LED driver according to embodiments of the present disclosure.

FIG. 4 is a block diagram of an LED driver 204 including a dual stage power converter 400 according to one or more preferred embodiments of the present disclosure. As shown in FIG. 4, the power converter 400 can preferably include an input circuit 430, a rectifier 402, a power factor correction converter stage 403, a resonant converter stage 404, and a main controller 406. Preferably, the power converter 400 can be configured to be installed in a one-gang box, receive the mains voltage $V_{AC}$, and output an output voltage $V_{OUT}$ and/or an output current $I_{OUT}$ to an LED lighting element. In some embodiments, the level of output voltage $V_{OUT}$ and/or the output current $I_{OUT}$ can be varied using a dimmer input.

In one preferred mode of operation, the mains voltage $V_{AC}$ is initially applied to the input circuit 401. The input circuit 430 can include an electromagnetic interference (EMI) circuit 401 and a rectifier 402. The EMI circuit 401 can be configured to filter out incoming EMI, preventing it from entering the power converter 400 from the mains voltage $V_{AC}$, and to filter out outgoing EMI, preventing the power converter 400 from emitting EMI out onto the mains voltage $V_{AC}$. This emission reduction and immunity has numerous advantages, including for example improving the electromagnetic compatibility of the power converter 400 and allowing the power converter 400 to operate at appropriate EMI levels.

In another preferred mode of operation, the mains voltage $V_{AC}$ is rectified by the rectifier 402, generating a rectified input voltage $V_{RECT}$. The rectifier 402 may be a diode bridge rectifier. The rectified input voltage $V_{RECT}$ is preferably smoothed to acquire a DC input voltage $V_{DC}$. Both the rectified input voltage $V_{RECT}$ and the DC input voltage $V_{DC}$ may be applied to the power factor correction converter stage 403 (hereinafter "PFC converter stage 403").

As shown in FIG. 4, the preferred the PFC converter stage 403 can receive the DC input voltage $V_{DC}$ and a control signal $V_{CONTROL}$ from the main controller 406. The PFC converter stage 403 generates a first stage voltage $V_1$, the level of which depends on the value of the control signal $V_{CONTROL}$. The PFC converter stage 403 can include a switched-mode power supply to generate the first stage voltage $V_1$. In some embodiments, the switched-mode power supply is a boost converter. Additionally, the PFC converter stage 403 can be operated to correct the power factor of the power converter 400, moving the power factor as close to 1 as possible. To this end, in some alternative embodiments, the switched-mode power converter may be operated by a PFC controller in transition mode. A transition mode PFC controller may keep the level of common mode currents very low when compared to a continuous mode PFC controller, reducing the required size of the EMI circuit 401. Additionally, a transition mode PFC controller may have better efficiency than a discontinuous mode PFC controller, increasing the efficiency and therefore power output of the PFC converter stage 403.

As shown in FIG. 4, the resonant converter stage 404 can include a resonant power converter (i.e. a switched-mode power supply utilizing a resonant topology). In some embodiments, the resonant power converter is a series resonant converter. In other embodiments, the resonant power converter is an LLC resonant converter. The resonant converter stage 404 is configured to receive the first stage voltage $V_1$ and generate an output voltage $V_{OUT}$ and/or an output current $I_{OUT}$.

In a preferred mode of operation, when the resonant converter stage 404 is enabled, it operates at a fixed frequency, with a fixed duty cycle and dead time. Conventionally, resonant converters have their switching frequency, duty cycle, and/or dead time varied to adjust the level of their output. However, a resonant converter may have differing EMI performance at different operating frequencies, and an EMI circuit coupled to the resonant converter may need to accommodate the worst-case performance. This problem can be particularly prominent when the output level of the converter needs to extend over a broader range, such as when using a dimmer input to vary the output voltage of the power converter. Driving the resonant converter stage 404 with a fixed waveform allows it to operate at the optimum frequency for EMI performance across the entire range of potential required output levels. This may reduce the worst-case EMI performance requirements presented to the EMI circuit 401, reducing the size of the components required and assisting in enabling the power converter 400 to fit within a one-gang box. Accordingly, instead of varying the switching frequency, duty cycle, and/or dead time, the levels of the output voltage $V_{OUT}$ and output current $I_{OUT}$ may be determined in a preferred mode of operation by the level of the first stage voltage $V_1$. The power converter 400 outputs the output voltage $V_{OUT}$ and the output current $I_{OUT}$ to the external LED load 420.

As shown in FIG. 4, a main controller 406 is preferably coupled to an output of the resonant converter stage 404. The main controller 406 preferably functions to receive feedback regarding the output of the power converter 400 and generates a control voltage $V_{CONTROL}$ based on that feedback. In some embodiments, the main controller 406 receives a voltage corresponding to the output voltage $V_{OUT}$. Based on $V_{OUT}$, the main controller 406 may generate the control voltage $V_{CONTROL}$ such that the power converter 400 operates in voltage mode, as a voltage source. In some alternative embodiments, the main controller 406 receives a current-sense voltage $V_{SENSE}$. The current-sense voltage $V_{SENSE}$ is the voltage across a current-sense resistor in series with the external LED load 420. Based on $V_{SENSE}$, the main controller 406 may generate the control voltage $V_{CONTROL}$ such that the power converter 400 operates in constant current mode, as a current source. The control voltage $V_{CONTROL}$ is passed to the PFC converter stage 403, where it determines the level of the first stage voltage $V_1$.

As shown in FIG. 4, in one variation of the preferred embodiment the main controller 406 can include a dimmer input 411. The dimmer input 411 can include a variable input device, such as a slider or a knob, that preferably functions to control the luminance of an external LED load 420 driven by the power converter 400. In one example configuration, the variable input device may be implemented using a variable resistor. Using the variable input device, a user can set a dimmer voltage $V_{DIM}$ of the dimmer input 411 to a value between a maximum dimmer voltage and a minimum dimmer voltage. The main controller 406 preferably generates the control voltage $V_{CONTROL}$ based on the value set for the dimmer voltage $V_{DIM}$, such that the levels of the output voltage $V_{OUT}$ and the output current $I_{OUT}$ vary corresponding to the dimmer voltage $V_{DIM}$.

In one alternative embodiment, the variable input may be a signal received from an outside system. The outside system may use the signal to control the dimmer voltage $V_{DIM}$ of the dimmer input 411, for example as part of a home automation system. In another alternative embodiment, the main controller 406 can include a maximum trimmer 413 and a minimum trimmer 414. Alternatively, the trimmers can be trim potentiometers, or resistive circuits that include a trim potentiometer. The maximum trimmer 413 and the minimum trimmer 414 set the maximum and the minimum output voltage or current values for the power converter 400. In other alternative embodiments, the maximum trimmer 413 and the minimum trimmer 414 function to set the maximum and minimum output voltage or current values by setting the maximum and minimum values for the dimmer voltage $V_{DIM}$.

In still other alternative embodiments, the main controller 406 can include an on/off switch 412. The on/off switch can be a toggle switch or other input device that may be used to select between two different input options, and generate an on/off signal $V_{ON/OFF}$ corresponding to the option currently selected. When the on/off switch is in the on position, the level of the output current is responsive to the control voltage $V_{CONTROL}$, and the main controller 406 controls the output voltage $V_{OUT}$ and the output current $I_{OUT}$ by controlling the level of the control voltage $V_{CONTROL}$. When the on/off switch is in the off position, the output voltage $V_{OUT}$ and the output current $I_{OUT}$ do not forward bias the external LED load 420. In variations of the alternative embodiment, the on/off signal $V_{ON/OFF}$ is passed to the PFC converter stage 403 and, when the on/off signal $V_{ON/OFF}$ corresponds to the off position, it controls the PFC converter stage 403 to generate the first stage voltage $V_1$ at a minimum value, regardless of the value of the control voltage $V_{CONTROL}$.

As shown in FIG. 4, in variations of the preferred embodiments, the dimmer 411, the on/off switch 412, the maximum trimmer 413, and the minimum trimmer 414 of can be configured as portions of the main controller 406. Alternatively, the dimmer 411, the on/off switch 412, the maximum trimmer 413, and/or the minimum trimmer 414 may be a separate element coupled to the main controller 406.

Because the output of the resonant converter stage 404 is controlled by the first stage voltage $V_1$, some embodiments turn the power converter 400 off by controlling the PFC converter stage 403 to output the first stage voltage $V_1$ at a minimum level. In these circumstances, or when the load is disconnected from the power converter 400, the PFC converter stage 403 and the resonant converter stage 404 may still be exposed to the mains voltage $V_{AC}$ and may still operate, and accordingly dissipate power. It is advantageous to minimize the power dissipated by the power converter 400 under such circumstances.

Figure 5:
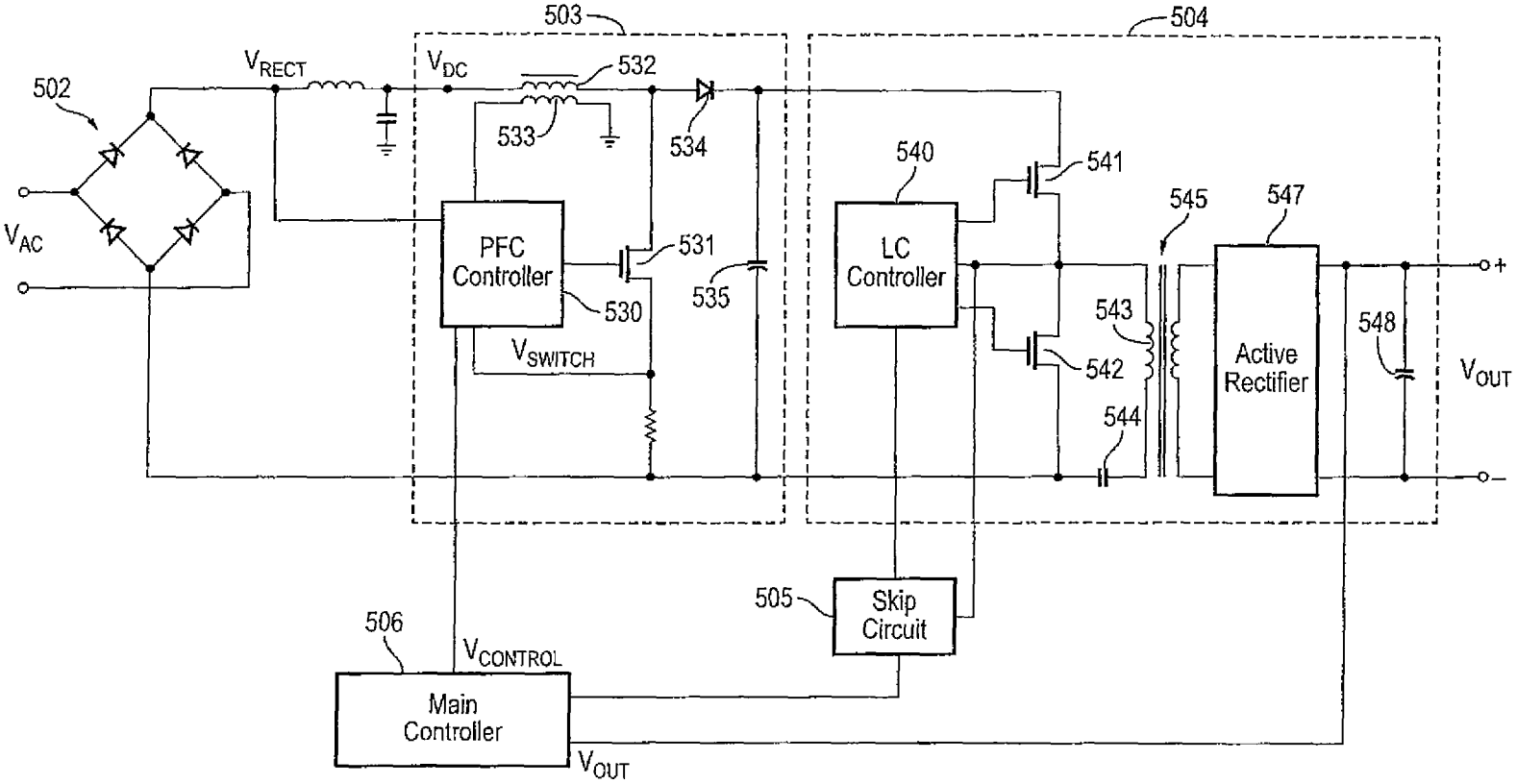
FIG. 5 is a circuit diagram of an LED driver according to embodiments of the present disclosure.

As shown in FIG. 5, some preferred embodiments of the power converter 400 include a skip circuit 405. The skip circuit 405 preferably functions to put the resonant converter stage 404 into skip mode or hiccup mode (hereinafter 'skip mode'). When in skip mode, the resonant converter is periodically enabled and disabled, reducing the output power of the resonant converter, and consequently the power dissipated. As a result, when in skip mode, the resonant converter stage 404 may generate a sufficient output to create bias voltages for the resonant converter stage 404 (and, in some embodiments, the PFC converter stage 403 and/or the main controller 406) but with an output voltage below that required to forward bias an external LED load 420. This reduces the power consumed when the power converter 400 is in an off-state without requiring the converter to be shut down completely, and may avoid the need for a standby converter, thereby reducing circuit cost and reducing space required that may assist in enabling the power converter to fit within a one-gang box. In some alternative embodiments, the skip circuit 405 puts the resonant converter stage 404 into skip mode when little or no output current $I_{OUT}$ is detected, indicating that no load is currently being powered by the power converter 400 output. In other alternative embodiments, the skip circuit 405 additionally or alternatively puts the resonant converter stage 404 into skip mode when the control voltage $V_{CONTROL}$ fails below a reference level. In other alternative embodiments, the reference level is a set level chosen to be enough above the saturation point of the of the circuit generating the control voltage $V_{CONTROL}$, for example the reference level may be set at 1 volt above the minimum saturation point of the circuit generating the control voltage $V_{CONTROL}$. In still other alternative embodiments, the skip circuit 405 is additionally or alternatively configured to act as an overvoltage protector, putting the resonant converter stage 405 into skip mode when it detects that the output voltage exceeds a certain level.

II. Exemplary Configurations

The following descriptions of several exemplary embodiments are illustrative of particular circuitry and/or design parameters that one of skill in the art might employ in making and using the claimed invention. Note that these embodiments are exemplary in nature, and should not be construed as limiting the scope of the claimed invention to exclude any alternative or functionally equivalent embodiments as otherwise described herein.

By way of illustration, FIG. 5 is a circuit diagram of an LED driver including a dual stage power converter according to one exemplary embodiment of the present disclosure. Note, for the sake of simplifying the figure, elements of the EMI circuit are omitted in FIG. 5. However, those of skill in the art will recognize that alternative embodiments of the dual stage power converter can include an EMI circuit as described elsewhere herein.

As shown in FIG. 5, in one exemplary mode of operation, the mains voltage $V_{AC}$ is rectified by diode bridge 502, generating a rectified input voltage $V_{RECT}$. The rectified input voltage $V_{RECT}$ is smoothed to acquire a DC input voltage $V_{DC}$. A PFC converter stage 503 can include a PFC controller 530. The PFC controller 530 preferably functions to generate a first stage voltage $V_1$, the level of which is determined based on a control voltage $V_{CONTROL}$ received from a main controller 506. In one example configuration, the PFC controller 530 can include a commercially available PFC controller integrated circuit, such as the L6562A transition-mode PFC controller from STMicroelectronics. The PFC controller 530 preferably drives a field effect transistor (FET) switch 531. The FET switch 531, a boost inductor 532, a diode 534, and a capacitor 535 form a boost converter. An inductor 533 preferably functions as a secondary to the boost inductor 532. The PFC controller 530 preferably uses the secondary inductor as a zero current detector 533 to determine when the current through the boost inductor 532 reaches zero. The PFC controller 530 can also receive a switching voltage $V_{SWITCH}$ that corresponds to the voltage across the FET switch 531, and the rectified input voltage $V_{RECT}$. Utilizing the zero current detector 533, the switching voltage $V_{SWITCH}$, and the rectified input voltage $V_{RECT}$, the PFC controller 530 can operate the boost converter in transition mode, thereby generating a first stage output voltage $V_1$ across capacitor 535 while increasing the power factor of the power converter 400. Alternative configurations for detecting the switching voltage $V_{SWITCH}$ and the zero current point in the boost inductor 532 can readily be devised by those of skill in the art; the configurations shown in FIG. 5 are exemplary and should not be interpreted in a limiting manner.

As shown in FIG. 5, a resonant converter stage 504 preferably can include a resonant converter controller 540. When enabled, the resonant converter controller 540 preferably functions to drive the resonant converter at a fixed frequency with a fixed duty cycle and dead time, resulting in an output voltage $V_{OUT}$ that is based on the level of the first stage voltage $V_1$. In an example configuration, the resonant converter controller 540 can include a commercially available resonant converter controller integrated circuit, such as the NCP1392B high-voltage half-bridge driver from ON Semiconductor. The resonant converter controller 540 preferably drives a first FET switch 541 and a second FET switch 542. The first and second FET switches 541 and 542 can be connected in series between the first stage voltage $V_1$ and ground. Inductor 543 (or the leakage inductance of inductor 543) and capacitor 544 form a series LC resonant tank. The resonant tank can be coupled to the node between the first and second FET switches 541 and 542. Inductor 543 also serves as the primary of a transformer 545. The first and second FET switches 541 and 542, the resonant tank, and the transformer 545 preferably cooperate to form a half-bridge resonant converter. An active rectifier 547 preferably rectifies the AC voltage on the secondary of the transformer 545 to generate the output voltage $V_{OUT}$ across the output capacitor 548. The main controller 506 may be coupled to the output of the active rectifier 547 to receive the output voltage $V_{OUT}$. In some embodiments, the main controller 506 may additionally or alternatively receive a current sense voltage $V_{SENSE}$ representative of the current delivered to the load. The main controller 506 preferably generates the control voltage $V_{CONTROL}$ that is coupled to the PFC controller 530.

In some alternative embodiments, a skip circuit 505 is coupled to the resonant converter controller 540. The skip circuit 505 is configured to place the resonant converter stage 504 into skip mode. The skip circuit 505 receives a signal from the main controller 506. In some embodiments, the signal is $V_{CONTROL}$ or corresponds to $V_{CONTROL}$. The skip circuit 505 may be configured to place the resonant converter controller 540 into skip mode when $V_{CONTROL}$ drops below a certain level, such as a set reference level. In some embodiments, the skip circuit 505 is also coupled to the node between the first and second FET switches 541 and 542 to receive the voltage across the tank circuit. The skip circuit 505 may place the resonant converter controller 540 into skip mode upon detecting that the voltage across the tank circuit exceeds a threshold.

In other alternative embodiments, the skip circuit 505 preferably functions to place the resonant converter stage 504 into skip mode by generating a skip signal and applying the skip signal to the resonant converter controller 540. For example, a FET switch may couple the enable input of a resonant converter controller 540 to ground, and the skip signal may be applied to the gate of the switch. When the skip signal is high, the enable pin is coupled to ground, shutting down the resonant converter controller 540. The duty ratio of the skip signal may be configured to provide the resonant converter with enough on-time to generate bias voltages sufficient to keep the resonant converter stage 504 (and, in some embodiments, the PFC converter stage 503) operational, but not to forward bias an external LED load.

Figure 6:
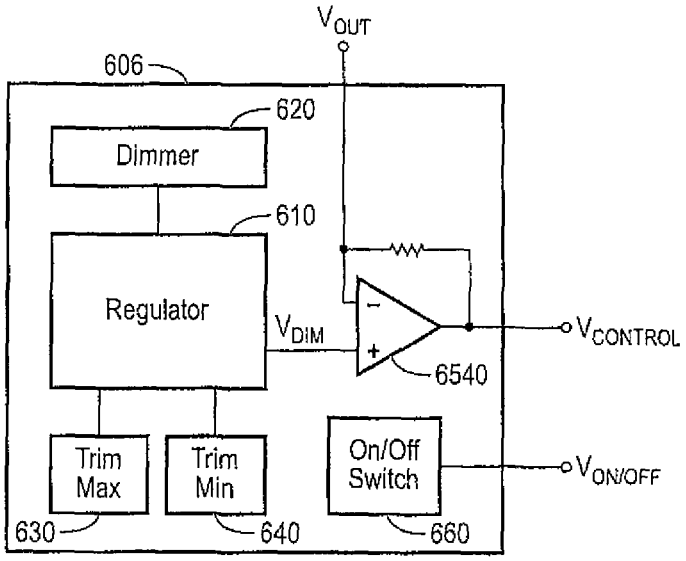
FIG. 6 is a block diagram of a main controller according to embodiments of the present disclosure.

FIG. 6 is a block diagram of one exemplary embodiment of a main controller 606. In some embodiments, the main controller 506 of FIG. 5 is implemented as the main controller 606 of FIG. 6. As shown in FIG. 6, the main controller 606 can preferably include a regulator 610. The regulator 610 can be coupled to a dimmer input 620, a maximum trimmer 630, and a minimum trimmer 640. Each of the dimmer input 620, the maximum trimmer 630, and the minimum trimmer 640 can have a separate variable input value set. The regulator 610 generates a dimmer voltage $V_{DIM}$ based on those values. The main controller 606 receives the output voltage $V_{OUT}$. An amplifier 650 compares the dimmer voltage $V_{DIM}$ and the output voltage $V_{OUT}$ to generate the control voltage $V_{CONTROL}$.

In some alternative embodiments, the main controller 606 may receive a current sense voltage $V_{SENSE}$ corresponding to the output current of the power converter 400 instead of the output voltage $V_{OUT}$. In such embodiments, the amplifier 650 may compare the current sense voltage $V_{SENSE}$ to the dimmer voltage $V_{DIM}$ to generate the control voltage $V_{CONTROL}$.

Figure 7:
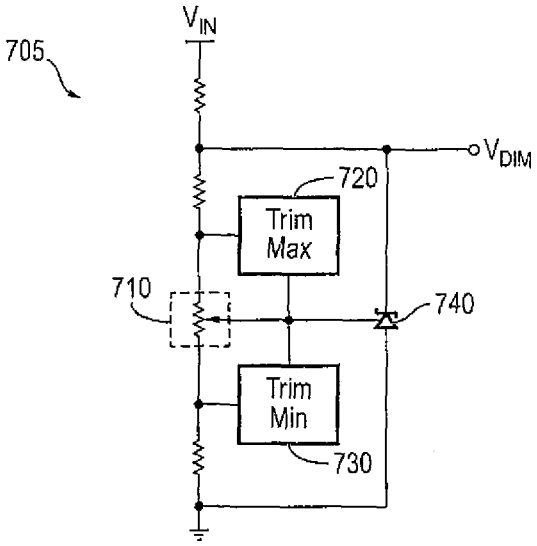
FIG. 7 is a circuit diagram of a regulator and dimmer input in a main controller according to embodiments of the present invention.

FIG. 7 is a circuit diagram of an exemplary regulator and dimmer input in a main controller according to an exemplary embodiment of the present invention. In some embodiments, the regulator 610 of FIG. 6 is implemented as the regulator of FIG. 7. As shown in FIG. 7, a dimmer input preferably can include a variable resistor 710. A voltage divider 705, which can include the variable resistor 710, can be coupled between a supply voltage VIN and ground. The voltage at the wiper terminal of the variable resistor 710 can preferably be applied to the reference terminal of an adjustable shunt regulator 740. A maximum trimmer 720 can be coupled between the wiper of the variable resistor 710 and a node on the voltage divider 705 with higher voltage than the voltage at the wiper. A minimum trimmer 730 can be coupled between the wiper of the variable resistor 710 and a node on the voltage divider 705 with lower voltage than the voltage at the wiper. For example, the maximum trimmer 720 may be coupled between the wiper and a first terminal of the variable resistor 710, and the minimum trimmer 730 may be coupled between the wiper and a second terminal of the variable resistor 710. The output voltage of the regulator, the voltage at the cathode of the adjustable shunt regulator 740, is the dimmer voltage $V_{DIM}$.

The maximum trimmer 720 and the minimum trimmer 730 preferably have adjustable resistance. In some embodiments, the trimmers are variable resistors or resistive circuits including variable resistors. The value of the resistance presented by the maximum trimmer 720 influences the maximum value of the dimmer voltage $V_{DIM}$. Similarly, the value of the resistance presented by the minimum trimmer 730 influences the minimum value of the dimmer voltage $V_{DIM}$. Accordingly, by adjusting the value of the resistances of the maximum trimmer 720 and the minimum trimmer 730, a user can program the maximum and minimum values of the dimmer voltage $V_{DIM}$, thereby programming the maximum and minimum values of the output voltage $V_{OUT}$ when it is being controlled by the control voltage $V_{CONTROL}$.

Figure 8:
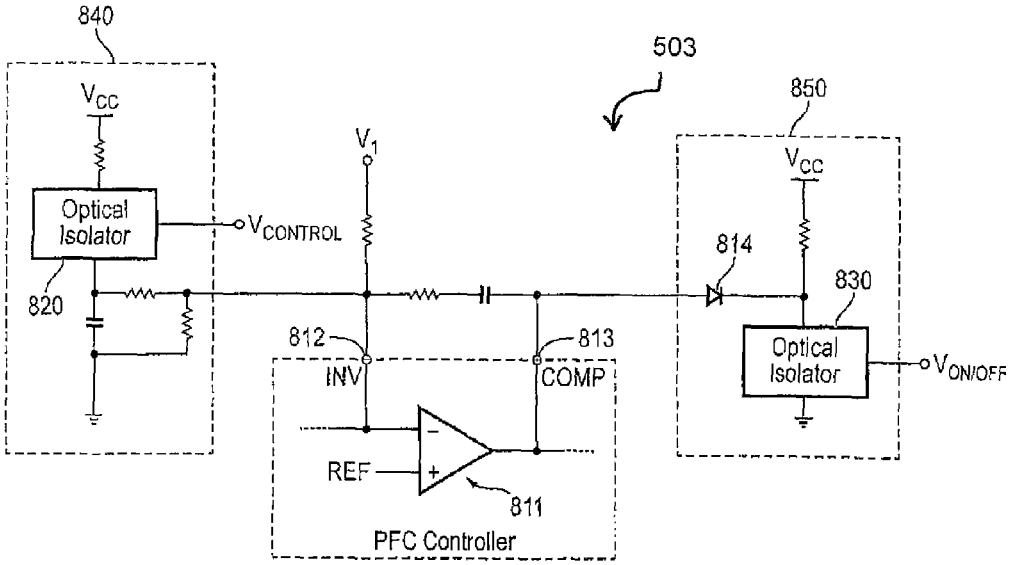
FIG. 8 is a circuit diagram of control circuit for a power factor correction converter according to embodiments of the present invention.

FIG. 8 is a circuit diagram of an exemplary embodiment of portions of the PFC converter stage 503 of FIG. 5. As shown in FIG. 8, the PFC converter stage preferably receives the first stage voltage $V_1$, the control voltage $V_{CONTROL}$, and the on/off signal $V_{ON/OFF}$. In some alternative embodiments, the control voltage $V_{CONTROL}$ and the on/off signal $V_{ON/OFF}$ may be generated by the main controller 606 of FIG. 6. The PFC converter stage can include an integrator 811 that preferably functions to output a gain voltage that determines the level of the first stage voltage $V_1$.

In some alternative embodiments, the PFC converter stage can include a PFC controller integrated circuit 810, such as for example the L6562A transition-mode PFC controller from STMicroelectronics. In such embodiments, the integrator 811 may be incorporated as an element of the integrated circuit 810. A first input 812, such as an INV input, may be coupled to the inverted input terminal of the integrator 811 and a second input 813, such as a COMP input, may be coupled to the output terminal of the integrator 811.

As shown in FIG. 8, the integrator 811 preferably compares a scaled version of the first stage voltage $V_1$ (received at its inverting input) to a reference voltage to generate the gain voltage. The level of the scaled version of the first stage voltage $V_1$ is influenced by a voltage control circuit 840. The voltage control circuit can include a first optical isolator 820, driven by the control voltage $V_{CONTROL}$. The value of the control voltage $V_{CONTROL}$ impacts the level of the scaled version of the first stage voltage $V_1$. For example, when the control voltage $V_{CONTROL}$ is low, an LED in the first optical isolator 820 may be forward biased, causing the first optical isolator 820 to conduct, thereby changing the voltage at the inverting input of the integrator 811. Because the gain voltage determines the level of the first stage voltage $V_1$, changing the level of the voltage at the inverting input of the integrator 811 can cause the PFC converter stage to control the first stage voltage $V_1$ to a different level.

A shown in FIG. 8, a shutdown circuit 850 can preferably be coupled to the output of the integrator 811. The shutdown circuit 850 can include a second optical isolator 830, driven by the on/off signal $V_{ON/OFF}$, coupled to the cathode of a diode 814. The anode of the diode 814 can preferably be coupled to the output of the integrator 811. The on/off signal $V_{ON/OFF}$ preferably forces the gain voltage to a level, such as a low level, because the gain voltage will not be able to exceed that level without forward-biasing the diode 814. In some embodiments, the on/off signal $V_{ON/OFF}$ is a binary signal. When the on/off signal $V_{ON/OFF}$ is high, the shutdown circuit 850 does not impact the level of the gain voltage. When the on/off signal $V_{ON/OFF}$ is low, the shutdown circuit 850 preferably forces the gain voltage to the low level, regardless of the scaled version of the first stage voltage $V_1$ received by the integrator 811. Accordingly, the on/off signal $V_{ON/OFF}$ can be used to switch the PFC converter stage, and therefore the dual stage power converter and the load, between an 'on' state influenced by the control voltage $V_{CONTROL}$ and an 'off' state.

Figure 9A:
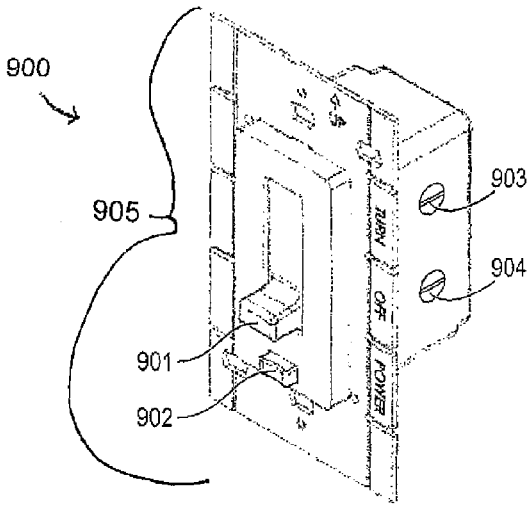
FIG. 9A is a perspective view of an LED driver including a housing containing a dual stage power converter according to embodiments of the present disclosure.

FIG. 9A is a diagram of an exemplary light switch 900 including a housing 905 containing an LED driver of the type described herein according to the preferred and exemplary embodiments of the present disclosure. The light switch 900, along with the housing 905, are preferably configured to be installed in a standard one-gang box. In some alternative embodiments, the housing 905 may fit within a one-gang box without protruding from the box substantially. In other alternative embodiments, the housing 905 may fit entirely within a one-gang box without protruding. A dimmer input 901 and an on/off switch 902 may be accessible from the outside of the housing 905, and a user may use them to set a dimmer voltage $V_{DIM}$ and an on/off signal $V_{ON/OFF}$, respectively. The housing 905 can contain a dual stage power converter such as the dual stage power converter described above with reference to FIG. 4. The light switch preferably receives an AC mains voltage $V_{AC}$ at the housing. The dual stage power converter preferably receives the AC mains voltage $V_{AC}$ and outputs a DC output voltage $V_{OUT}$ and current $I_{OUT}$ from the housing. The DC output voltage $V_{OUT}$ and current $I_{OUT}$, when wired to an external LED load, are capable of powering the LED load without requiring any components external to the housing 905.

In some alternative embodiments, maximum trimmer 903 and minimum trimmer 904 are accessible to the outside of the housing 905. The trimmers 903 and 904 may be positioned on the housing 905 such that they are accessible during installation, but are inaccessible or are more difficult to access after installation. For example, the trimmers 903 and 904 may be positioned on a portion of the housing 905 that is inside the one-gang box after the housing 905 is fully installed. FIG. 9B is side view of the light switch 900 of FIG. 9A, with the housing 905 removed to show components of the LED driver inside. The circuitry is compact and efficient in order to fit in a standard wall installation.

III. Method

FIG. 10 is a flow chart depicting a method 1100 of converting power according to a preferred embodiment of the present disclosure. As shown in FIG. 10, the preferred method 1100 can include block 1101, which recites that the maximum and minimum values of an output voltage $V_{OUT}$ of a power converter are adjusted. This may be particularly useful where the power converter can include a variable input such as a dimmer input that allows a user to vary the power converter output voltage $V_{OUT}$. In some embodiments, the maximum and minimum values of the output voltage $V_{OUT}$ may be programmed by a user upon installing a power converter or upon using the power converter for the first time. The maximum and minimum values of the output voltage may be set to correspond to the maximum and minimum operating voltages for an external LED load device. Accordingly, the power converter may accommodate variations in minimum threshold voltage that occur in LEDs, and may accommodate different external LED load devices with differing voltage requirements.

Block 1102 of the preferred method 1100 recites rectifying the mains voltage $V_{AC}$ to get a DC input voltage $V_{DC}$. In some embodiments this is performed by a rectifier, such as a diode bridge. Block 1103 of the preferred method 1100 recites converting the DC input voltage $V_{DC}$ to a first stage voltage $V_1$. Power factor correction is preferably performed, and the DC input voltage $V_{DC}$ is converted into the first stage voltage $V_1$. The level of the first stage voltage $V_1$ is based on the level of a control voltage $V_{CONTROL}$. In some embodiments, block 1103 is performed by, or performed using, a first switched-mode power supply operating in transition mode. For example the switched-mode power supply may be a boost converter.

As shown in FIG. 10, block 1104 of the preferred method 1100 recites converting a first stage voltage $V_1$ into the output voltage $V_{OUT}$. Block 1104 is preferably performed by, or performed using, a second switched-mode power supply operating at a fixed frequency with a fixed duty cycle and dead time. Accordingly, when the second switched-mode power supply is enabled, the level of the output voltage $V_{OUT}$ may be a function of the level of the first stage voltage $V_1$. In some embodiments, the second switched-mode power supply is a resonant converter.

As shown in FIG. 10, block 1105 of the preferred method 1100 recites generating a control voltage $V_{CONTROL}$. In some embodiments, block 1105 is preferably performed by, or performed using, a main controller such as the main controller described above with reference to FIG. 6. The level of the control voltage $V_{CONTROL}$ is based on the level of the output voltage $V_{OUT}$. In some embodiments, the control voltage $V_{CONTROL}$ is generated at a level to control the first stage voltage $V_1$ such that the output voltage $V_{OUT}$ is maintained at a constant level, thereby providing a voltage source. In alternative embodiments, the control voltage $V_{CONTROL}$ is generated at a level to control the first stage voltage $V_1$ such that an output current $I_{OUT}$ corresponding to the output voltage $V_{OUT}$ is maintained at a constant level, thereby providing a current source.

In some embodiments, as discussed above, a variable input such as a dimmer input allow a user to vary the desired output voltage $V_{OUT}$. In such embodiments, a dimmer voltage $V_{DIM}$ may be received from the variable input. The dimmer voltage $V_{ON}$ may be compared to the output voltage $V_{OUT}$, and the control voltage $V_{CONTROL}$ may be generated at a level to control the first stage voltage $V_1$ such that the output voltage $V_{OUT}$ (or output current $I_{OUT}$) is maintained at a level corresponding to the dimmer voltage $V_{DIM}$.

As shown in FIG. 10, the preferred method 1100 can include decision block 1106, which queries whether the power converter should be placed into a shutdown mode. In some embodiments, the circuit should be placed into shutdown mode when the level of the control voltage $V_{CONTROL}$ passes a threshold corresponding to a low output voltage $V_{OUT}$. In some embodiments, the circuit should additionally or alternatively be placed into shutdown mode when the output current $I_{OUT}$ drops below a certain threshold For example, when there is zero output current $I_{OUT}$, it may be determined that the circuit should be placed into shutdown mode, as the load may have been disconnected or switched off external to the power converter. In some embodiments, the circuit should additionally or alternatively be placed into shutdown mode when an on/off signal indicates that an on/off switch is in an off position. When it is determined that the power converter should be placed into shutdown mode, the method proceeds to block 1107.

As shown in FIG. 10, block 1107 of the preferred method 1100 recites reducing the level of the first stage voltage $V_1$ in response to an affirmative decision in decision block 1106. In some embodiments, the main controller controls the first switched-mode power supply to output a lower voltage. For example, in some embodiments, the control voltage $V_{CONTROL}$ may be generated at a level corresponding to a lower level. Where the control voltage $V_{CONTROL}$ passing a threshold lead to the determination to enter shutdown mode at block 1106, the level of the first stage voltage $V_1$ may have been reduced prior to making the determination. In some embodiments, such as where an on/off signal or a lack of output current $I_{OUT}$ lead to the determination to enter shutdown mode at block 1106, the level of the control voltage $V_{CONTROL}$ may be overridden to cause the reduction of the first stage voltage $V_1$ or a separate signal may be sent to the main controller or the first switched-mode power supply in order to cause the reduction of the first stage voltage $V_1$.

As shown in FIG. 10, block 1108 of the preferred method 1100 recites placing the second switched-mode power supply into skip mode. In some embodiments, a skip circuit causes the second switched-mode power supply to be in skip mode by periodically enabling and disabling the switched-mode power supply. In some embodiments, the skip circuit monitors the parameter or parameters responsible for the determination to enter shutdown mode in block 1106. Based on the monitoring, the skip circuit determines when to place the second switched-mode power supply into skip mode. In some embodiments, the main controller sends a signal to the skip circuit indicating that the second switched-mode power supply should be placed into skip mode.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the terms "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory that may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

While this invention has been described in detail with particular references to illustrative embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims and equivalents thereof.

What is claimed is:

1. An LED driver comprising:

a power converter disposed in a one-gang box to receive an AC mains voltage and to output a DC output voltage for driving an LED device, the power converter comprising:

a rectifier to receive the AC mains voltage and convert the AC mains voltage into a DC input voltage;

a power factor correction (PFC) converter stage to receive the DC input voltage, perform power factor correction, and generate a first stage voltage; and a resonant converter stage to receive the first stage voltage and generate an output voltage;

a dimmer input disposed within the one-gang box to vary a level of the DC output voltage; and a main controller, wherein:

the PFC converter stage is to generate the first stage voltage at a level, the level of the first stage voltage based on a control voltage, the main controller is to receive the output voltage and to generate the control voltage based on the output voltage, and the resonant converter stage is configured to operate at a fixed frequency with a fixed duty cycle and dead time when the dimmer input varies the level of the DC input voltage.

2. The LED driver of claim 1 wherein the power converter is configured to generate up to a 100 watt output.

3. The LED driver of claim 1 wherein the power converter is configured to have an efficiency of at least 92%.

4. The LED driver of claim 1 wherein the dimmer input varies the level of the DC output voltage by varying the level of the first stage voltage.

5. The LED driver of claim 1, wherein the PFC converter stage is operable in a transition mode.

6. The LED driver of claim 5, wherein the PFC converter stage comprises a boost converter.

7. The LED driver of claim 1, wherein the resonant converter stage comprises a series resonant converter.

8. The LED driver of claim 1, wherein the resonant converter stage comprises an LLC resonant converter.

9. The LED driver of claim 1, wherein the output voltage is the voltage delivered to the LED device, and the main controller controls the control voltage such that the output voltage has a constant value.

10. The LED driver of claim 1, wherein the output voltage is a current sense voltage corresponding to an output current in the LED device, and wherein the main controller uses the current sense voltage as a feedback to control the control voltage such that the output current has a constant value.

11. The LED driver of claim 1, wherein the dimmer input is configured to generate a dimmer voltage at a level, and wherein the main controller controls the control voltage to maintain the output voltage at a level based on the dimmer voltage level.

12. The LED driver of claim 11, wherein the main controller is programmable with a maximum value of the output voltage and a minimum value of the output voltage.

13. The LED driver of claim 1, further comprising a first trim potentiometer coupled to the main controller, wherein the main controller controls the output voltage to a maximum value, and wherein the first trim potentiometer determines the maximum value of the output voltage.

14. The LED driver of claim 13, further comprising a second trim potentiometer coupled to the main controller, wherein the main controller controls the output voltage to a minimum value, and wherein the second trim potentiometer determines the minimum value of the output voltage.

15. The LED driver of claim 1, further comprising a skip circuit that causes the resonant converter stage to enter a skip mode when the control voltage is below a reference level.

16. The LED driver of claim 15, wherein when the resonant converter stage is in skip mode, the output voltage is below a threshold required to bias the LED device.

17. The LED driver of claim 15, wherein the skip circuit causes the resonant converter stage to enter the skip mode by periodically enabling and disabling the resonant converter stage.

18. The LED driver of claim 1, further comprising an electromagnetic interference circuit disposed within the one-gang box.

19. The LED driver of claim 1, further comprising a housing disposable within the one-gang box and containing the rectifier, the PFC converter stage, the resonant converter stage, and the main controller.

20. An LED driver comprising:

a power converter disposed in a one-gang box to receive an AC mains voltage and to output a DC output voltage for driving an LED device, the power converter comprising:

a rectifier to receive the AC mains voltage and convert the AC mains voltage into a DC input voltage;

a power factor correction (PFC) converter stage to receive the DC input voltage, perform power factor correction, and generate a first stage voltage;

a resonant converter stage to receive the first stage voltage and generate an output voltage; and a main controller, wherein the PFC converter stage generates the first stage voltage at a level, the level of the first stage voltage based on a control voltage, the resonant converter stage is operable at a fixed frequency with a fixed duty cycle and dead time, and the main controller receives the output voltage and generates the control voltage based on the output voltage;

a dimmer input disposed within the one-gang box to vary a level of the DC output voltage; and a skip circuit that causes the resonant converter stage to enter a skip mode when the control voltage is below a reference level.

21. The LED driver of claim 20, wherein when the resonant converter stage is in skip mode, the output voltage is below a threshold required to bias the LED device.

22. The LED driver of claim 20, wherein the skip circuit causes the resonant converter stage to enter the skip mode by periodically enabling and disabling the resonant converter stage.

* * * * *